US005198246A

United States Patent [19]

Bowen

[11] Patent Number: 5,198,246

[45] Date of Patent: Mar. 30, 1993

[54] CONCRETE MOLDING DEVICE

[75] Inventor: Kenneth T. Bowen, Frederick, Md.

[73] Assignee: Monoform, Inc., Frederick, Md.

[21] Appl. No.: 588,839

[22] Filed: Sep. 27, 1990

[51] Int. Cl.[5] ..... E02D 29/12

[52] U.S. Cl. ..... 425/432; 249/11; 425/59; 425/456

[58] Field of Search ..... 425/432, 456, 59; 249/10, 11; 264/32

[56] References Cited

U.S. PATENT DOCUMENTS

| | | | |
|---|---|---|---|
| 1,787,449 | 1/1931 | Jackson | 425/456 |
| 2,614,312 | 10/1952 | Rankin et al. | 425/456 |
| 2,884,901 | 5/1959 | Chandler et al. | 425/456 |
| 3,470,279 | 9/1969 | Abbott | 425/432 |
| 3,551,967 | 1/1971 | Williams | 425/456 |
| 3,611,516 | 10/1971 | O'Connor et al. | 425/432 |
| 3,726,508 | 4/1973 | Varnello et al. | 425/456 |
| 3,771,769 | 11/1973 | Niemi et al. | 425/432 |
| 3,813,068 | 5/1974 | Binsfeld | 425/432 |
| 3,954,377 | 5/1976 | Scholz et al. | 425/432 |
| 4,351,507 | 9/1982 | Toffolon et al. | 425/432 |
| 4,579,697 | 4/1986 | Takano | 264/40.1 |
| 4,990,082 | 2/1991 | Lee | 425/456 |
| 4,995,584 | 2/1991 | Trimble | 264/32 |

*Primary Examiner*—Jay H. Woo
*Assistant Examiner*—James P. Mackey
*Attorney, Agent, or Firm*—Larson & Taylor

[57] ABSTRACT

A concrete molding device is provided for settling poured concrete. In a preferred embodiment, the form is composed of a plurality of segments stacked one upon the other, each having at least one strengthening flange located on its inner periphery. A vibratory unit containing a base unit provided with a slot is then attached to a flange in tongue and groove fashion.

6 Claims, 2 Drawing Sheets

CONCRETE MOLDING DEVICE

FIELD OF THE INVENTION

This invention relates generally to concrete forming equipment and to a vibrator mountable thereon for settling poured concrete.

BACKGROUND OF THE INVENTION

Currently, there are several companies that sell circular forms for manhole rehabilitation. These forms are generally constructed of plastic or steel. The process of manhole rehabilitation consists of first erecting the form within an existing manhole structure and then filling the space between the outer surface of the form and the existing manhole structure with concrete, creating a new concrete liner in the space.

As with any type of concrete placement, concrete consolidation is vital to a quality finished product. In the past, concrete has been consolidated by using eccentric cam internal vibrators which had to be inserted into the actual concrete. This creates a large number of problems in this particular forming situation due to:

1) the fact there is only 1–4 inches of space between the form and the existing manhole structure;
2) the difficulty involved in feeding the vibrator head past the corbel area of the form; and
3) the lack of visual confirmation of consolidation usually seen in normal forming situations.

Several examples of such vibrators are disclosed in U.S. Pat. Nos. 3,726,508 (Varnello); 3,551,967 (Williams); 3,470,279 (Abbott); and 3,771,769 (Niemi).

Unfortunately, all of these prior art devices have the various disadvantages mentioned above.

SUMMARY OF THE INVENTION

In accordance with the invention, poured concrete is settled using a concrete molding device comprising a form member having at least one strengthening flange located on the side of the form member opposite that of the poured concrete and a vibratory means mounted on said flange for settling the poured concrete. Preferably the vibratory means is provided with a slot at its distal end by means of which it is removably mounted to a strengthening flange in tongue and groove fashion.

According to a preferred embodiment the form has a cylindrical shape and strengthening flanges are located on the inner periphery of the form and one or more vibratory means for settling said concrete are attached to one or more of said strengthening flanges. The flanges preferably circumscribe the inner periphery of the form.

In perhaps its most practical aspect the form comprises a cylindrical portion and a tapered conical portion whose base rests on top of the cylindrical portion. Both the cylindrical portion and conical portion are comprised of a plurality of segments each of which contains a strengthening flange at the top and bottom on its inner surface by which the segments can be stacked and secured one on top of the other in modular fashion.

The novel molding device of the invention as aforementioned eliminates the problem commonly encountered in tight wall forming applications where the introduction of internal vibrators is not possible or often impeded as where the manhole form contains a corbel that defines an angle between an upper conical portion and a lower cylindrical portion.

Use of the external vibratory means pursuant to the invention, moreover, offers a further advantage in that the entire forming surface becomes the means for consolidation. The vibration of the forming system as opposed to a localized area of concrete penetration by internal vibration units, has been found to produce a much higher quality level of wall finish to the entire periphery of the liner.

The removable feature that characterizes the vibratory means of the invention is also advantageous for several reasons. Since manhole form stack-ups are rarely the same due to the varying physical dimensions of the original structures, the ability to mount the vibrator means at desired points within a given form stack-up so as to optimize concrete consolidation is of a considerable advantage. This is not always possible with either permanently attached vibrators or internally placed vibrators where effective use is highly dependent upon exact insertion spacing around the periphery of the form, a feat often difficult to achieve.

Lastly, the removable vibrator means of the invention lend themselves to fast disassembly and reassembly in different manhole setups.

Other features and advantages of the invention will be set forth in, or apparent from, the following detailed description of the preferred embodiment of the invention.

DESCRIPTION OF THE PRIOR ART DEVICE

Figure 1:
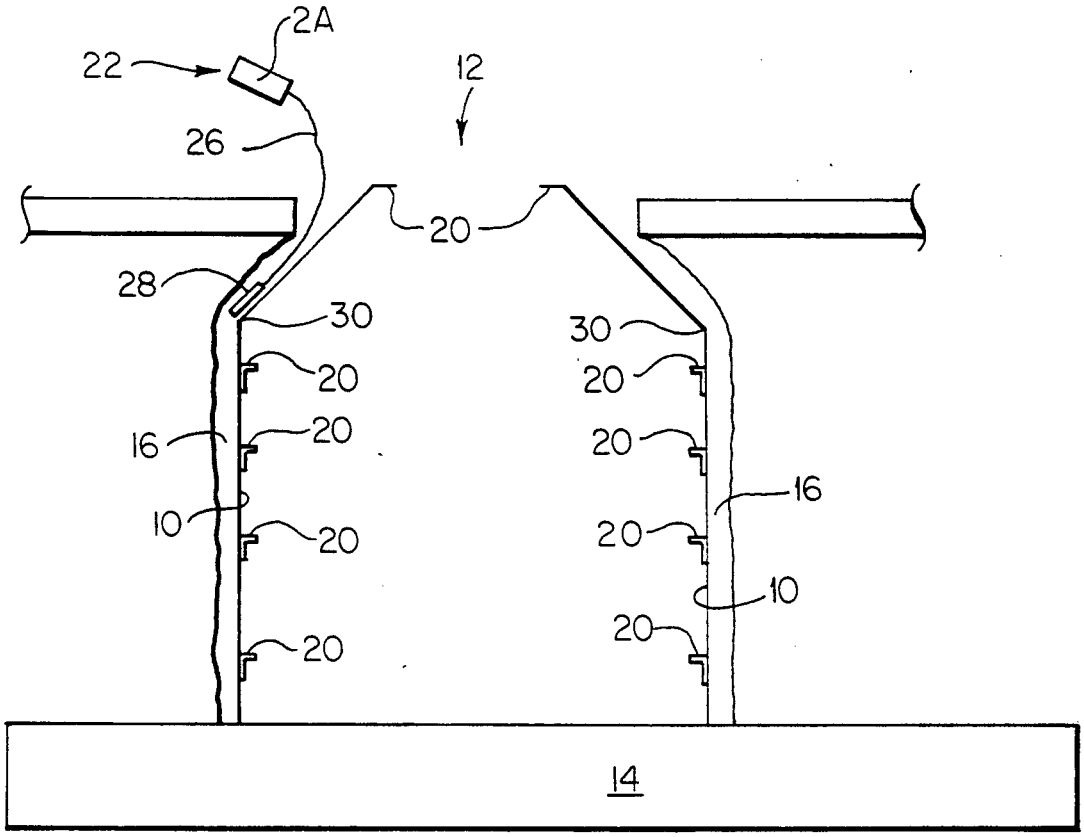
FIG. 1 PRIOR ART
FIG. 1 is a front elevation view of a prior art device for concrete consolidation.

Referring to FIG. 1, a front elevational view of the environment in which a prior art concrete consolidation device is shown. A circular form 10 is positioned in a hole 12. Form 10 is placed in hole 12 so as to contact sewer pipe 14 and allow a 3–4 inch air gap 16 between the outer surface of form 10 and the walls of hole 12. Most conventional manhole forms 10 have a plurality of strengthening flanges 20 located on their inner surface when the form 10 is in place. Concrete is poured into gap 16 around the form and the concrete is allowed to settle either by its own weight or by the use of a vibrator indicated generally as 22. This vibrators generally are composed of a power supply or pack 24, an extension device 26, and a vibratory head 28 inserted in gap 16. However, as may be seen in FIG. 1, it is often not possible to insert vibratory head 28 into the poured concrete at the lower levels of gap 16 due to a bend in form 10 where the cylindrical walls of form 10 join corbel 30. This creates the problem of uneven settling of the poured concrete. The concrete molding device of the invention remedies this problem as well as overcomes other aforementioned shortcomings of other prior art devices.

DESCRIPTION OF THE PREFERRED EMBODIMENTS OF THE INVENTION

Figure 2:
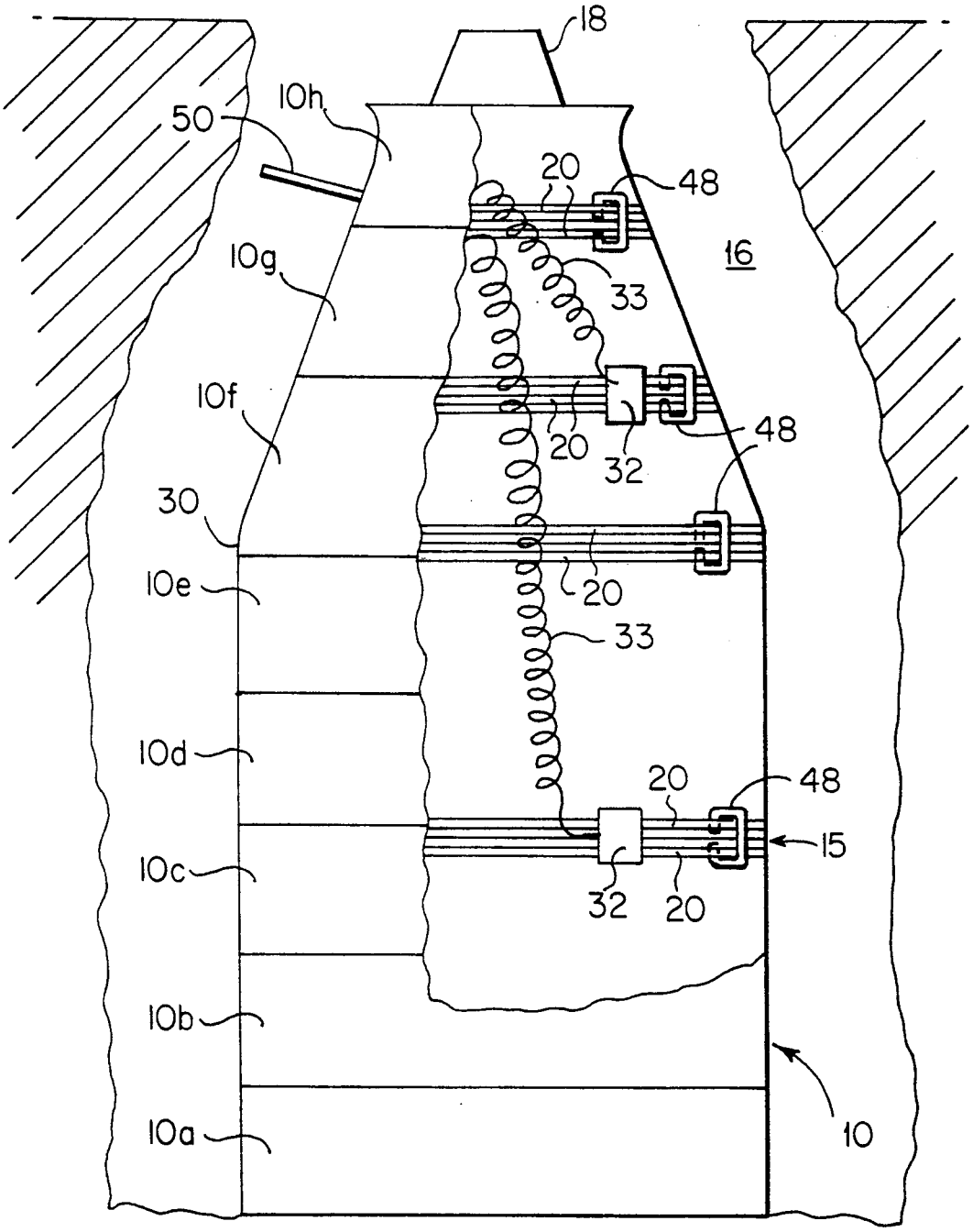
FIG. 2 is a perspective view of a partially cut-away to show the vibratory means mounted on the strengthening flange of the concrete molding device of the invention.

Referring to FIG. 2, a form 10 is composed of separate segments or sections labeled **10*a* through 10*h*. As may be seen, sections 10***a* through 10*e* have the same diameter and are stacked and secured one to the other to form a cylinder designated generally as 15 having a desired height. The height of cylinder 15 may be adjusted by either adding additional sections or by removing sections as needed to fit the particular requirements at the cite. Secured to the top of cylinder 15 is a tapered section 10*f* which has the same diameter as section 10*a* at its base and a narrower diameter at the top. Attached to section 10*f* is section 10*g* which has a shallower taper than section 10*f* and is designed so that the bottom diameter of 10*g* corresponds to the top diameter of 10*f*. A top section 10*h* attaches to tapered section 10*g* so as to provide a finished opening for the access hole. A top 18 covers section 10*h* to prevent concrete from accidentally being poured into the cavity formed by form 10. Each section 10*a* through 10*h* contains strengthening flanges 20 located at the top and bottom inner surfaces of these sections.

The form is constructed by stacking sections 10*a* through 10*e* in hole 12 or a preexisting manhole structure. Additional sections may be added or removed until an appropriate height is reached. Then sections 10*f* through 10*h* are stacked on top of sections 10*a* through 10*e* as depicted in FIG. 2. The corbel 30 is formed by attaching section 10*e* to section 10*f*.

After the form 10 is aligned in the hole 12 by use of a centering rod 50, the sections are securely attached by "C" clamps 48 or any other attaching means known in the art. These "C" clamps 38 attach the upper flange of one section to a lower flange of the next section. In this manner the various sections are assembled to construct form 10 as illustrated in FIG. 2. The vibratory means designated generally as 32 are mounted on the inner surface of form 10 to help in the settling of the poured concrete. The vibratory means 32 is described in detail below. Supply lines 33 are attached to and provide power to vibratory means 32.

Figure 3:
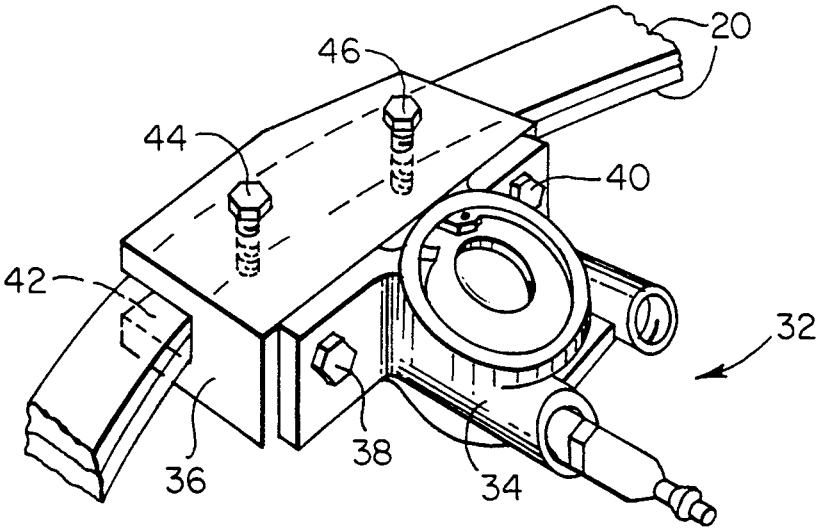
FIG. 3 is a detailed perspective view of the tongue and groove vibratory means mounted on the strengthening flange of the concrete molding device.

Referring to FIG. 3, vibratory means 32 is composed of a vibratory unit 34 which may be actuated by air or water pressure, electricity or any other power means known in the art. Vibratory unit 34 is mounted to a base unit 36 by a pair of bolt 38 and 40 or any othe fastening means known in the mounting art. Base unit 36 contains a slot 4 on the end distal from vibratory unit 34. Slot 42 is designed to engage strengthening flanges 20 and thus form a tongue and groove mount secured thereto by a pair of bolts or screws 44 and 46 or by any other fastening means known in the art. Slot 42 provides the ability to mount the vibratory means 32 anywhere on one or more of the plurality of strengthening flanges 20 located on the inner surface of concrete form 10, thus allowing for the optimum settling of the poured concrete while it hardens. It should be noted that in the embodiment of the invention wherein the sections or segments are stacked to construct the form slot 42 is large enough to accomodate two strengthening flanges 20 that is, the bottom flange of one segment resting on the top flange of a lower segment. In general, the configuration of the mounted vibratory means is in the shape of a helix working toward the top of the forms. The number used will vary depending upon the actual manhole height as well as the slump and wall thickness of the concrete to be vibrated.

Although the present invention has been described to specific exemplary embodiments thereof, it will be understood by those skilled in the art that variations and modifications can be effected in these exemplary embodiments without departing from the scope and spirit of the invention. An example of such a modification would be the use of non-cylindrical forms, i.e., rectangular, square, hexagonal or straight forms.

It is claimed:

1. A concrete molding device for settling poured concrete comprising a form comprised of a cylindrical portion and a conical portion, the base of said conical portion being secured to the top of said cylindrical portion, each of said cylindrical and conical portions being comprised of a plurality of segments stacked one on top of the other, each of said segments including inwardly directed strengthening flanges at the top and bottom of the inner surfaces thereof, means joining together the flange of one segment to the flange of an adjacent segment to provide joined flanges which secure said one segment to said adjacent segment, and vibratory means for settling concrete poured around the outside of the form, said vibratory means comprising a vibratory unit including a base portion including a slot therein in which is received said joined flanges and the internal shape of which conforms and mates with the external shape of the joined flanges received therein so as to provide a tongue and groove mount for said vibratory unit, and at least one connector bolt securing the base portion of the vibratory unit to said joined flanges.

2. A concrete molding device according to claim 1 including means for centering said device in a hole in the ground.

3. A concrete molding device according to claim 1 wherein said vibratory means is powered pneumatically.

4. A concrete molding device according to claim 1 wherein said vibratory means is powered by water pressure.

5. A concrete molding device according to claim 1 wherein said vibratory mean sis powered by electricity.

6. A concrete molding device according to claim 1 wherein said strengthening flanges each comprise a continuous member.

* * * * *